US008786393B1

(12) United States Patent
Chen

(10) Patent No.: US 8,786,393 B1
(45) Date of Patent: Jul. 22, 2014

(54) STEP UP OR STEP DOWN MICRO-TRANSFORMER WITH TIGHT MAGNETIC COUPLING

(71) Applicant: Baoxing Chen, Westford, MA (US)

(72) Inventor: Baoxing Chen, Westford, MA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 13/759,366

(22) Filed: Feb. 5, 2013

(51) Int. Cl.
*H01F 38/20* (2006.01)
*H01F 27/28* (2006.01)
*H01F 5/00* (2006.01)

(52) U.S. Cl.
USPC ..... 336/173; 336/174; 336/180; 336/182; 336/200; 336/232

(58) Field of Classification Search
USPC ..... 336/173, 174, 147, 180, 182, 138, 200, 336/220, 232
See application file for complete search history.

(56) References Cited

U.S. PATENT DOCUMENTS

| | | | | |
|---|---|---|---|---|
| 3,537,022 | A | 10/1970 | Regan | |
| 4,027,152 | A | 5/1977 | Brown et al. | |
| 4,273,051 | A * | 6/1981 | Stratton | 102/202.2 |
| 4,489,357 | A | 12/1984 | Van Ooijen et al. | |
| 4,748,419 | A | 5/1988 | Somerville | |
| 5,070,317 | A | 12/1991 | Bhagat | |
| 5,095,357 | A | 3/1992 | Andoh et al. | |
| 5,097,371 | A | 3/1992 | Somers | |
| 5,126,714 | A | 6/1992 | Johnson | |
| 5,184,103 | A * | 2/1993 | Gadreau et al. | 336/84 C |
| 5,321,321 | A | 6/1994 | Kurisu | |
| 5,387,551 | A | 2/1995 | Mizoguchi et al. | |
| 5,445,922 | A | 8/1995 | Maple | |
| 5,478,773 | A | 12/1995 | Dow et al. | |
| 5,502,430 | A | 3/1996 | Takahashi et al. | |
| 5,548,265 | A * | 8/1996 | Saito | 336/200 |
| 5,572,179 | A * | 11/1996 | Ito et al. | 336/200 |
| 5,701,037 | A | 12/1997 | Weber et al. | |
| 5,877,667 | A * | 3/1999 | Wollesen | 336/200 |
| 5,952,849 | A | 9/1999 | Haigh | |
| 6,008,102 | A | 12/1999 | Alford et al. | |

(Continued)

FOREIGN PATENT DOCUMENTS

EP 0 714 131 5/1996

OTHER PUBLICATIONS

PCT International Search Report and Written Opinion from PCT/US2012/046458, mailed on Sep. 18, 2012, corresponding to U.S. Appl. No. 13/273,726.

(Continued)

*Primary Examiner* — Alexander Talpalatski
*Assistant Examiner* — Kazi Hossain
(74) *Attorney, Agent, or Firm* — Kenyon & Kenyon LLP

(57) ABSTRACT

A system and method for manufacturing of a micro-transformer providing direct electrical isolation between a primary winding and a secondary winding while featuring tight magnetic coupling for a large possible step-up or step-down ratio. The micro-transformer may be implemented in an integrated circuit, and may include a magnetic core. A high stepping ratio, e.g. approximately 50 to 100, may be achieved by connecting multiple symmetric primary windings in parallel and multiple symmetric secondary windings in series, or vice-versa. A plurality of windings may be stacked vertically. The micro-transformer may be of particular utility in wireless sensor networks, thermal and vibrational energy harvesters, power converters, and signal isolators.

34 Claims, 8 Drawing Sheets

(56) References Cited

U.S. PATENT DOCUMENTS

| | | | | |
|---|---|---|---|---|
| 6,054,780 | A | 4/2000 | Haigh et al. | |
| 6,054,914 | A | 4/2000 | Abel et al. | |
| 6,060,977 | A | 5/2000 | Yamamoto et al. | |
| 6,087,882 | A | 7/2000 | Chen et al. | |
| 6,198,374 | B1 | 3/2001 | Abel | |
| 6,262,600 | B1 | 7/2001 | Haigh et al. | |
| 6,303,971 | B1 | 10/2001 | Rhee | |
| 6,356,183 | B1 | 3/2002 | Jou | |
| 6,593,841 | B1 | 7/2003 | Mizoguchi et al. | |
| 6,873,065 | B2 | 3/2005 | Haigh et al. | |
| 6,922,080 | B2 | 7/2005 | Haigh et al. | |
| 7,075,329 | B2 | 7/2006 | Chen et al. | |
| 7,262,680 | B2 | 8/2007 | Wang | |
| 7,298,238 | B1 | 11/2007 | Eaton et al. | |
| 7,302,247 | B2 | 11/2007 | Dupuis | |
| 7,376,212 | B2 | 5/2008 | Dupuis | |
| 7,421,028 | B2 | 9/2008 | Dupuis | |
| 7,447,492 | B2 | 11/2008 | Dupuis | |
| 7,449,987 | B2 | 11/2008 | Snyder | |
| 7,460,604 | B2 | 12/2008 | Dupuis | |
| 7,489,526 | B2 | 2/2009 | Chen et al. | |
| 7,545,059 | B2 | 6/2009 | Chen et al. | |
| 7,548,440 | B2 | 6/2009 | Chen et al. | |
| 7,558,080 | B2 | 7/2009 | Chen et al. | |
| 7,577,223 | B2 | 8/2009 | Alfano et al. | |
| 7,613,016 | B2 | 11/2009 | Chen et al. | |
| 7,683,654 | B2 | 3/2010 | Chen et al. | |
| 7,692,444 | B2 | 4/2010 | Chen et al. | |
| 7,719,305 | B2 | 5/2010 | Chen | |
| 7,788,608 | B2 | 8/2010 | Huynh et al. | |
| 7,859,085 | B2 | 12/2010 | Pagaila et al. | |
| 7,876,188 | B2 | 1/2011 | Tarng et al. | |
| 7,920,010 | B2 | 4/2011 | Chen, Jr. et al. | |
| 7,978,041 | B2 * | 7/2011 | Bertilsson | 336/200 |
| 7,983,059 | B2 | 7/2011 | Chen | |
| 8,084,894 | B2 | 12/2011 | Chen | |
| 8,089,311 | B2 | 1/2012 | Chen | |
| 2003/0234436 | A1 | 12/2003 | Hsu et al. | |
| 2004/0070481 | A1 | 4/2004 | Patel et al. | |
| 2004/0113741 | A1 | 6/2004 | Li et al. | |
| 2005/0088269 | A1 * | 4/2005 | Hatano | 336/200 |
| 2005/0269657 | A1 | 12/2005 | Dupuis | |
| 2005/0271148 | A1 | 12/2005 | Dupuis | |
| 2005/0271149 | A1 | 12/2005 | Dupuis | |
| 2005/0272378 | A1 | 12/2005 | Dupuis | |
| 2006/0039224 | A1 | 2/2006 | Lotfi et al. | |
| 2008/0013635 | A1 | 1/2008 | Dupuis | |
| 2008/0025450 | A1 | 1/2008 | Alfano et al. | |
| 2008/0031286 | A1 | 2/2008 | Alfano et al. | |
| 2008/0119142 | A1 | 5/2008 | Dupuis | |
| 2008/0180206 | A1 * | 7/2008 | Fouquet et al. | 336/200 |
| 2008/0238601 | A1 * | 10/2008 | Das et al. | 336/200 |
| 2008/0260050 | A1 | 10/2008 | Dupuis | |
| 2008/0267301 | A1 | 10/2008 | Alfano et al. | |
| 2008/0317106 | A1 | 12/2008 | Leung et al. | |
| 2009/0017773 | A1 | 1/2009 | Dupuis et al. | |
| 2009/0027243 | A1 | 1/2009 | Leung et al. | |
| 2009/0091414 | A1 | 4/2009 | Hopper et al. | |
| 2009/0213914 | A1 | 8/2009 | Dong et al. | |
| 2009/0243028 | A1 | 10/2009 | Dong et al. | |
| 2010/0072570 | A1 | 3/2010 | Pagaila et al. | |
| 2011/0095620 | A1 | 4/2011 | Fouquet et al. | |
| 2011/0255208 | A1 * | 10/2011 | Petruska et al. | 361/263 |
| 2012/0020117 | A1 | 1/2012 | Arnold et al. | |

OTHER PUBLICATIONS

Wang et al., "Embedded Integrated Inductors with a Single Layer Magnetic Core," Oral presentation, International Workshop on Power Supply on Chip, PwrSOC08, Sep. 23, 2008.

Wright et al., "Analysis of Integrated Solenoid Inductor With Closed Magnetic Core", IEEE Transactions on Magnetics, 46(6):2387-2390, Jun. 2010.

Lazarczyk, "Comparison of Fields Emitted From High Frequency Silicon-Integrated, Microfabricated Inductors". Power Electronics and Applications, 2009. EPE '09.

International Search Report and Written Opinion dated Sep. 12, 2012 in PCT/US2012/045069, filed Jun. 29, 2012.

International Search Report and Written Opinion of the International Searching Authority in counterpart International application No. PCT/US2014/014676, communication dated May 21, 2014.

* cited by examiner

TOP VIEW

SIDE VIEW

STEP UP OR STEP DOWN MICRO-TRANSFORMER WITH TIGHT MAGNETIC COUPLING

CROSS REFERENCE TO RELATED APPLICATIONS

The present application is related to U.S. application Ser. No. 13/273,726, entitled "A Small Size And Fully Integrated Power Converter With Magnetics On Chip", filed on Oct. 14, 2011. This related application is hereby incorporated by reference in its entirety.

BACKGROUND

The present invention relates to a micro-transformer that may provide galvanic isolation between a primary winding and a secondary winding while providing a large step-up or step-down ratio via tight magnetic coupling. The micro-transformer may be implemented in an integrated circuit.

Transformers enable magnetic signal transfer between two or more circuit networks via mutual inductance, while providing direct electrical (i.e., galvanic) isolation. Such isolation may prevent extraneous transient signals, including common-mode transients, from being inadvertently processed as intended signals. Isolation may also protect equipment from shock hazards, or permit equipment on either side of an isolation barrier to operate at different supply voltages without necessarily sharing a common ground connection. Optical isolators are used to provide such isolation by converting input electrical signals to light signals, and then converting the light signals back into electrical signals again, but they have numerous known disadvantages.

Transformers also enable alternating voltages and currents of the magnetically coupled circuit networks to be stepped up or down significantly, ideally with no overall power loss. The ratio of the number of turns in the primary winding to the number of turns in the secondary winding determines the stepping ratio for ideal transformers. Transformers are accordingly used in power supplies and power converters for a wide variety of applications.

Small transformers are often manufactured from discrete components, versus components that can be made by planar processes like those used to manufacture integrated circuits. As used herein, a "micro-transformer" refers to a small transformer in which at least one winding is formed using planar fabrication methods, including but not limited to semiconductor fabrication techniques. At present, micro-transformers are quite limited in stepping ratio and power transfer efficiency.

Accordingly, the inventor has identified a need in the art for an improved micro-transformer to provide the benefits of isolation but with improved stepping ratio and power transfer efficiency.

DETAILED DESCRIPTION

Embodiments of the invention provide a micro-transformer apparatus, and a method for manufacturing a micro-transformer. The micro-transformer enables direct electrical isolation between a primary winding and a secondary winding, while featuring tight magnetic coupling for a large possible stepping ratio and improved power transfer efficiency. Each winding may be thought of as a magnetic field generating element coupled magnetically with a magnetic field receiving element.

One difficulty in the creation of such a micro-transformer is the need to achieve close magnetic coupling between the primary and secondary windings. Another difficulty is in physically realizing designs with a high relative number of winding turns between the primary and secondary windings. Further, the minimum winding pitch and maximum integrated circuit size are limited, as are the number of different metal and insulating layers available in a given manufacturing process. The embodiments described address these difficulties and constraints.

Figure 1A:
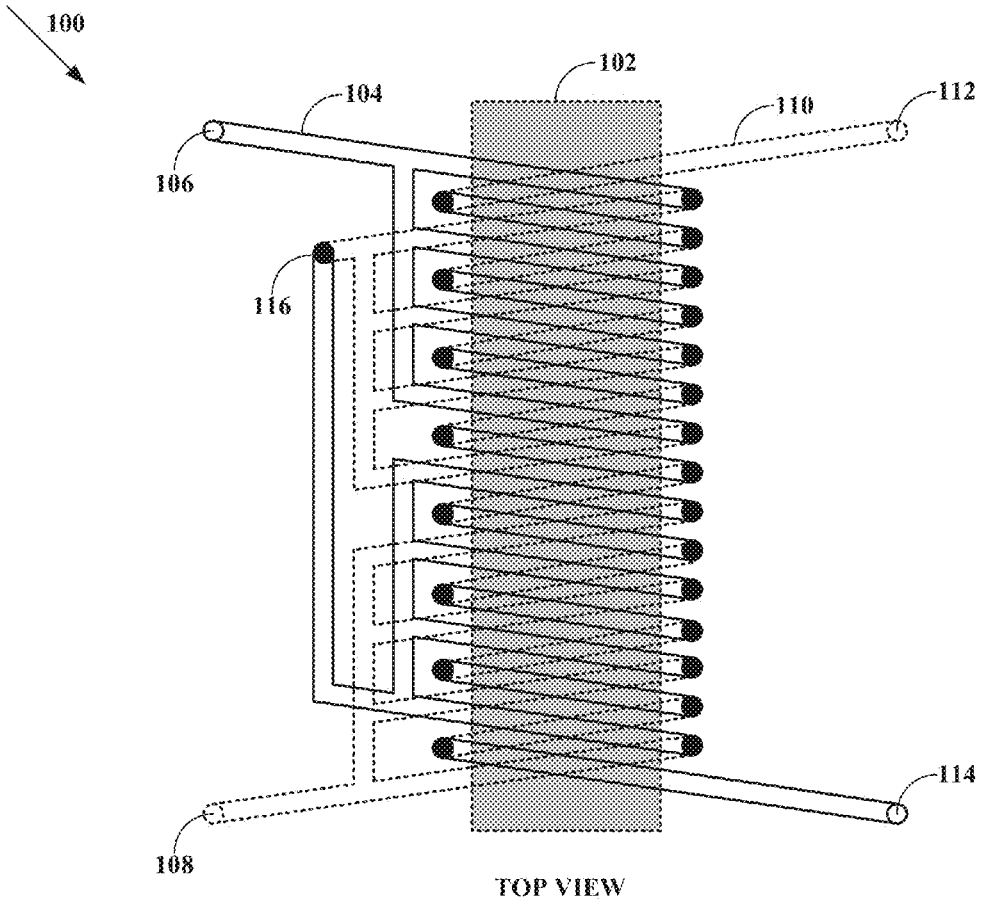
FIGS. 1A-1C are diagrams depicting an exemplary micro-transformer according to one embodiment of the present invention.
Figure 1A:
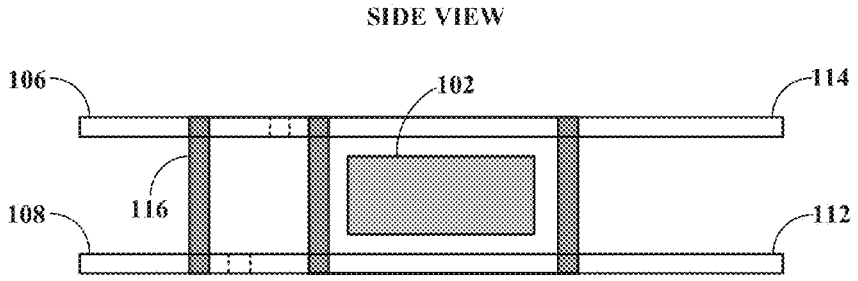

Referring now to FIG. 1A, a diagram depicting an exemplary micro-transformer 100 according to one embodiment of the present invention is shown. This figure is a top view and side view of the micro-transformer, fabricated using planar processes that may include but are not limited to semiconductor fabrication technologies. Structures on an upper layer are shown in solid lines in the top view, while structures on at least one lower layer are shown in dashed lines in the top view. An optional region of magnetic core material is shown as item 102; this material may be positioned on one layer or on multiple layers, if available.

Primary winding 104 may begin at terminal 106, proceed laterally through conductive stripes on an upper layer, downward through substantially vertical interconnection structures or "vias" (shown as black circles), and laterally through conductive stripes on a lower layer. In this example, primary winding 104 may continue upward through via 116, laterally through conductive stripes on an upper layer, downward through vias, and laterally through conductive stripes on a lower layer, altogether forming two complete turns that end at terminal 108. Insulating layers (not shown) may be disposed between various conductive layers to provide electrical (i.e. galvanic) isolation. Insulating layers may comprise silicon dioxide, silicon nitride, or polyimide, for example.

Lower layer portions of the primary winding 104 on the left side of the diagram connecting to via 116 are shown offset to the left slightly for clarity; an actual fabricated micro-transformer winding may not be so offset, to provide better winding symmetry. Similarly, via 116 may be placed more centrally between the two primary winding turns, or may be placed elsewhere that a winding "tap" may be desired.

Each primary winding turn may be split into (in this example) four conductive stripes, to allow the secondary winding turns to intertwine to provide better magnetic coupling. Although in this example the primary winding 104 has two turns, any number of turns may be employed.

The secondary winding 110 may begin at terminal 112, on a lower layer in this example, proceed laterally through a conductive stripe on a lower layer, upward through a via, and laterally through a conductive stripe on an upper layer to complete one winding turn. In this example, secondary winding 110 may comprise eight such repeated winding turns in series, and may end on an upper layer at terminal 114, but other configurations are possible. For example, each winding may have its terminals on the same or different layers.

Figure 1B:
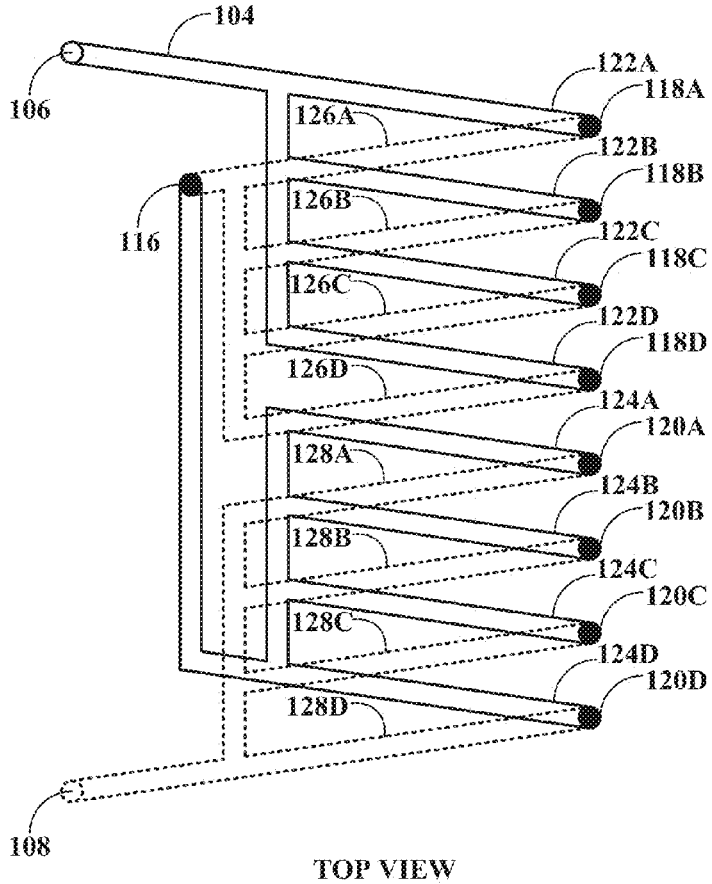
Figure 1B:
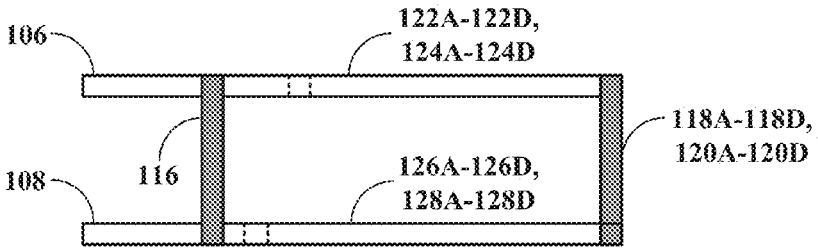

FIG. 1B depicts the primary winding 104 of the FIG. 1A micro-transformer 100 alone for clarity. Vias 118A-118D may transport current in the first turn substantially vertically between an upper layer and a lower layer. Vias 120A-120D may similarly transport current in the second turn substantially vertically between an upper layer and a lower layer. Conductive stripes 122A-122D and 124A-124D conduct current substantially horizontally on an upper layer, while conductive stripes 126A-126D and 128A-128D conduct current substantially horizontally on a lower layer.

Figure 1C:
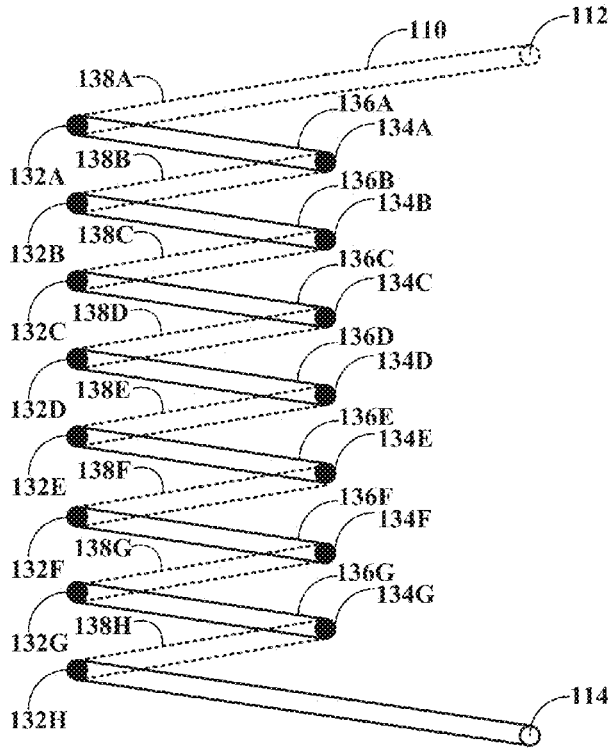
Figure 1C:
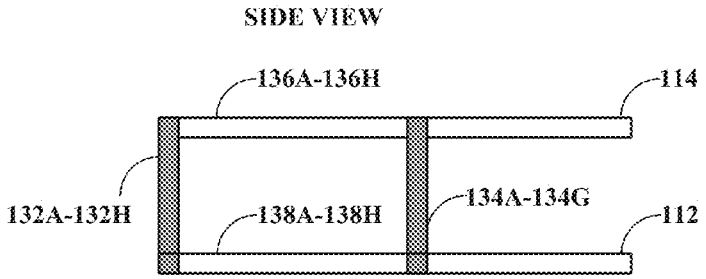

Similarly, FIG. 1C depicts the secondary winding 110 of FIG. 1A micro-transformer 100 alone for clarity. Vias 132A-132H and 134A-134G may transport current in the secondary winding 110 substantially vertically between an upper layer and a lower layer. Conductive stripes 136A-136H conduct current substantially horizontally on an upper layer, while conductive stripes 138A-138H conduct current substantially horizontally on a lower layer. In this exemplary micro-transformer 100, only two layers, an upper layer and a lower layer, are depicted for clarity but an actual fabricated micro-transformer may employ any number of layers to produce as many windings as needed. Any of the layers may be selectively interconnected by vias or other conductive structures. Multiple micro-transformers may also be interconnected.

The embodiment of FIGS. 1A-1C may use symmetric and alternately spaced intertwined conductive stripes for both the primary and secondary windings. This feature may be optimized to pack the windings as closely together as the design rules for a given process will allow. Such packing minimizes overall circuit size while helping to ensure a close magnetic coupling between the windings. Although multiple-turn windings are shown for both the primary and secondary windings of the exemplary micro-transformer 100, single turns may be used if appropriate for the application for which the micro-transformer 100 will be used. Micro-transformers having a one-to-one stepping ratio may be of particular use in isolator applications.

A variety of conductive materials may be used to form the windings, including but not limited to metals and doped semiconductor regions. The conductive materials may include those already used to fabricate metal traces in integrated circuits, such as aluminum and copper. Non-process metals (e.g., gold) may also be deposited after a substrate has been processed to include circuit elements. This approach may allow the windings to be thicker than typical metal layers used in an integrated circuit process, providing a higher inductance to resistance ratio.

The windings may have portions placed within a substrate, on a substrate, or deposited onto an electrically insulating film that covers a substrate for example, so the various upper and lower portions of the windings may be oriented substantially parallel to the substrate surface. The capacitance between the substrate and the lower portions of the windings may be reduced by placing the windings above a relatively thick electrically insulating film. Vertical portions of the windings (e.g., the vias of FIGS. 1A-1C) may connect the upper portions of the windings to the lower portions of the windings through openings cut through selected intervening layers. The overall magnetic field resulting from currents flowing through the conductive windings may be oriented substantially parallel to the substrate.

Further, this embodiment may allow one set of windings (e.g., the stripes and vias of FIGS. 1A-1C) to be effectively connected in parallel to increase the magnetic flux generated by a given input. Other winding sets may be connected in series to increase the induced output voltage. The combination of these features may enable quite a large stepping ratio. For example, if the primary winding is connected in parallel while the secondary winding is connected in series, the secondary voltage may be stepped up by a large factor, e.g. 50 to 100. Similarly, if the primary winding is connected in series while the secondary winding is connected in parallel, a large step-down voltage ratio may be achieved. A large step-down voltage ratio may be of particular utility for sensing large voltages. A large step-up voltage ratio may be of particular utility in energy harvesting applications, to be described.

Figure 2A:
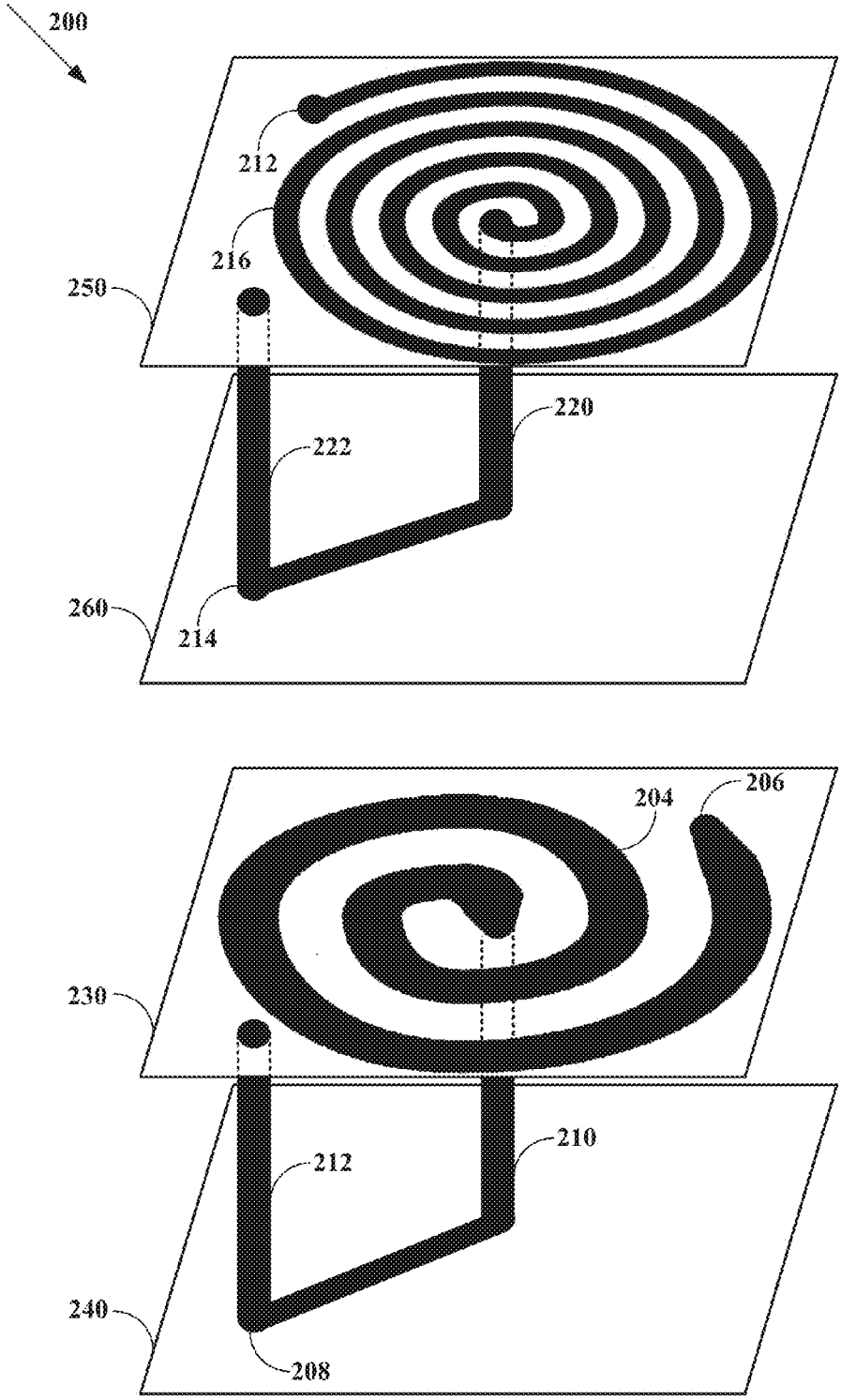
FIGS. 2A-2B are diagrams depicting an exemplary micro-transformer according to another embodiment of the present invention.

Referring now to FIG. 2A, a diagram depicting an exemplary micro-transformer 200 according to another embodiment of the present invention is shown. This micro-transformer 200 may use stacked spiral windings that may be layered substantially parallel with a substrate, with insulating layers (not shown) between the windings providing direct electrical (i.e. galvanic) isolation.

In advanced integrated circuit fabrication processes, there may be many layers of metal available to form the spiral windings. Connections to each spiral winding may be made on a given vertical layer at the outside edge of the spiral, and through an inter-layer connection or "via" at the central region of the spiral winding to allow current flow through an intervening insulating layer to a neighboring or other conductive layer.

A first spiral winding 204 may be positioned on a first layer 230, and have a first terminal 206 on that layer. A second terminal 208 may be positioned on another layer 240, with a via 210 providing a conductive interconnection between the layers 230 and 240. The second terminal 208 may be connected to a point on the same layer 230 as first terminal 206 by another via 212.

A second spiral winding 216 may be positioned on another layer 250, and have a first terminal 212 on that layer. A second terminal 214 may be positioned on yet another layer 260, with a via 220 providing a conductive interconnection between the layers 250 and 260. The second terminal 214 may be connected to a point on the same layer 250 as first terminal 212 by another via 222. Although the windings are depicted as round spirals, all other winding shapes (e.g., rectangular spirals, hexagonal spirals, etc.) may be used. Further, although the first spiral winding 204 is depicted as having approximately 1.5 turns and the second spiral winding 216 is depicted as having approximately 4.5 turns for clarity, the number of turns in each winding may be tailored to suit individual application needs.

Figure 2B:
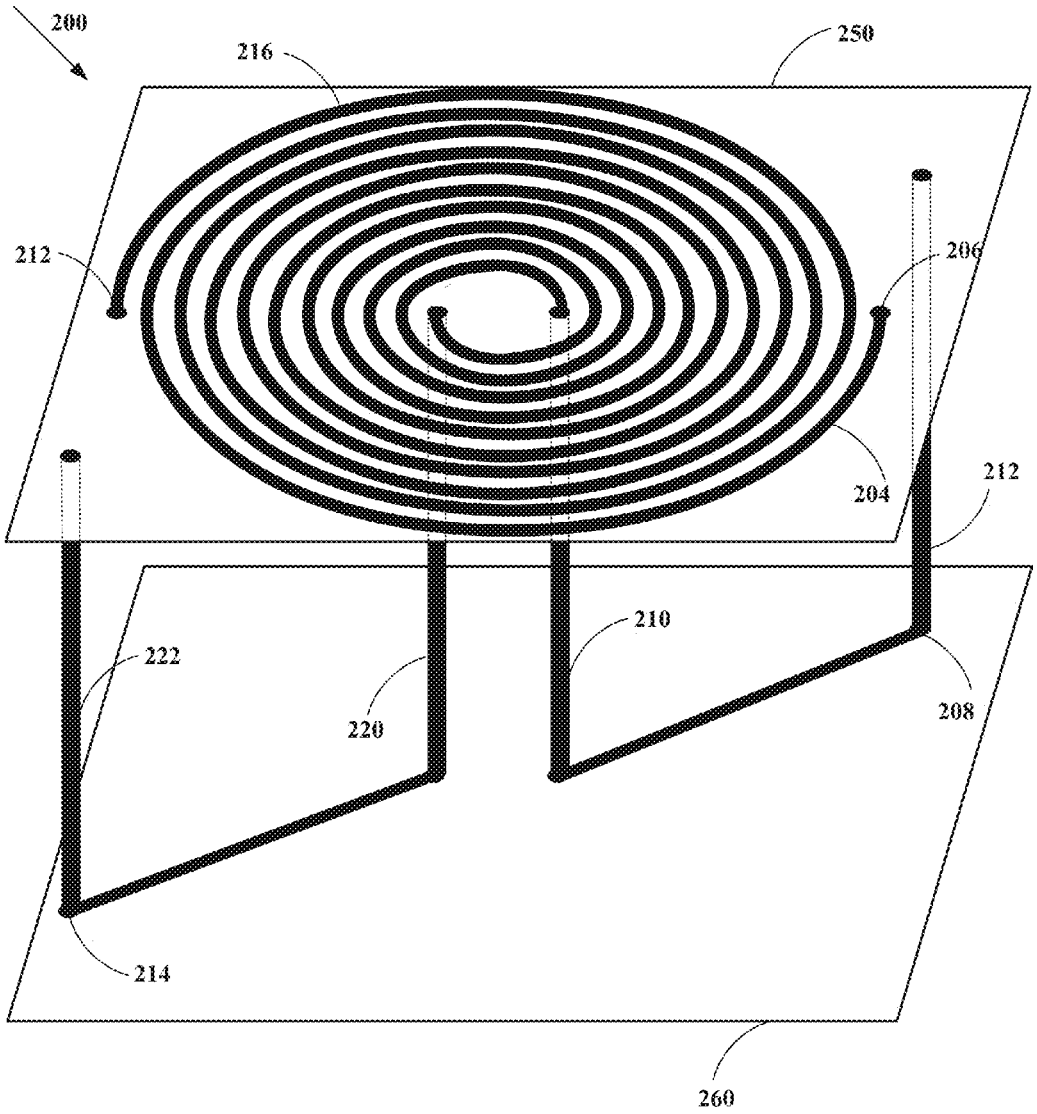

Micro-transformer 200 may pack the windings as closely together vertically as the design rules for a given process will allow, to minimize overall circuit size, while helping ensure a close magnetic coupling between the windings. The winding layers may alternate, so that a primary winding is proximate to a secondary winding. Similarly, as shown in a variation depicted in FIG. 2B, concentrically wound primary and secondary windings may be placed proximately on a common layer. Vias may connect their inner terminals to another layer for example as previously described. The overall magnetic field resulting from currents flowing through the conductive windings may be oriented substantially perpendicular to the substrate.

The diameter of the individual spiral windings may be made relatively large compared to the separation between the individual spiral windings, to achieve tighter magnetic coupling. Similarly, symmetry between the primary windings and the secondary windings, however many spirals each may comprise, may be maximized to avoid degradation of the magnetic coupling. In practice, magnetic coupling ratios of 0.8 may be achieved with reasonable spiral sizes. Such a micro-transformer may have an exemplary power transfer efficiency of ten to fifteen percent. Alternating currents that switch at a frequency from ten MHz to 20 MHz for example may be used by such a micro-transformer, though operation at over 100 MHz may be feasible.

As previously described, the different windings of this embodiment may also be connected in parallel or serially as needed to yield a high stepping ratio. For example, when stepping up a voltage from the primary side to the secondary side of the micro-transformer, the primary spiral windings may be connected in parallel and the secondary spiral windings may be connected in series. The turning direction of a winding may also be selected to yield an induced voltage of desired relative polarity.

Figure 3:
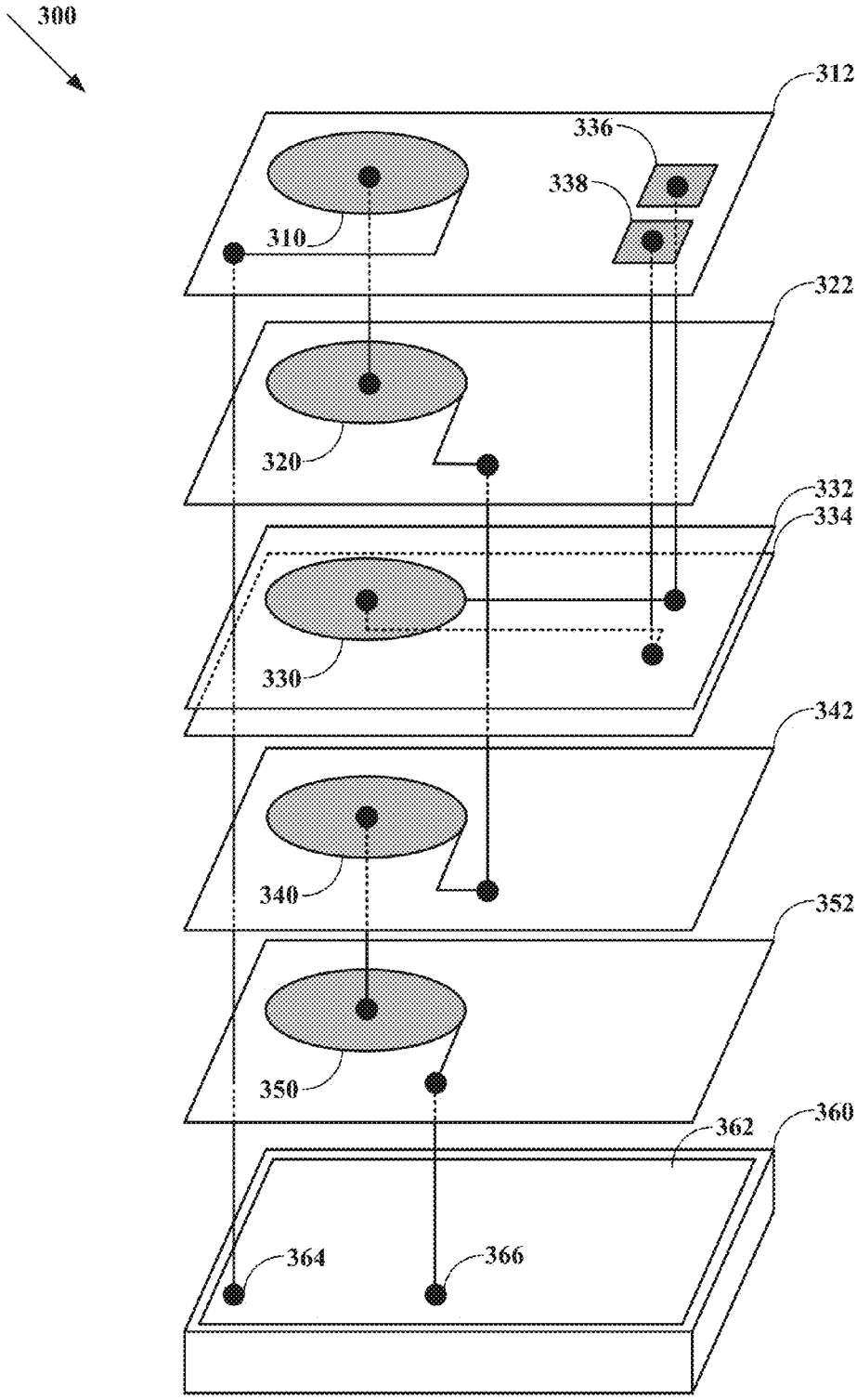
FIG. 3 is a diagram depicting an exemplary micro-transformer circuit according to a further embodiment of the present invention.

Referring now to FIG. 3, a diagram depicting an exemplary micro-transformer circuit 300 according to a further embodiment of the present invention is shown. This micro-transformer 300 also may use stacked spiral windings that may be layered substantially parallel with a substrate, with insulating layers (not shown) between the windings providing direct electrical (i.e. galvanic) isolation. A single spiral winding may be vertically surrounded by one or more turns of the other winding on other layers above and/or below the single spiral winding.

In this example, two secondary windings 310 and 320 may be positioned on layers 312 and 322 above a primary winding 330 on layers 332 and 334, and two secondary windings 340 and 350 may be positioned on layers 342 and 352 below primary winding 330. The primary side of micro-transformer 300 may include various contact pads and connections as well as a spiral winding. Thus the primary side may begin at contact pad 336 on layer 312, proceed downward through intervening layers (e.g., 322) by a via, laterally to an exterior edge of spiral winding 330, downward again through another via to layer 334, and up to contact pad 338. The vias providing electrical interconnection to contact pads 336 and 338 may allow external connection of a primary voltage source (not shown), but the invention is not so limited. A primary voltage source may be available on any interior layers or on substrate 360. Contact pads such as 336 and 338 may be separated from each other and from the windings to the extent possible, to decrease capacitive coupling.

The secondary side of exemplary micro-transformer circuit 300 may begin at node 364, shown in this example as being within integrated circuitry 362 on substrate 360. A via may interconnect node 364 to an exterior edge of secondary winding 310 through intervening layers (e.g., 322, 332, 334, 342, and 352). Another via may interconnect secondary winding 310 to secondary winding 320, forming a series winding pair. Secondary windings 340 and 350 are similarly interconnected, and attached to the upper secondary winding pair through another via. Secondary winding 350 may connect by a via to node 366, shown here as being within exemplary integrated circuit 362.

The total number of turns in the secondary side of micro-transformer 300 may thus significantly exceed the number of turns in any of the particular secondary windings. Further, each secondary winding may have many more turns than the single primary winding shown. For example, if the primary winding has two turns while each of the secondary windings has twenty-five turns, an exemplary overall turns ratio of 100:2 or 50 may be achieved, with a seven metal layer process.

In this embodiment, a primary winding voltage applied to contact pins 336 and 338 may cause an electrical current to flow through primary winding 330, which generates a magnetic field. The magnetic field may couple to all of the series-connected secondary windings, inducing a significantly stepped-up overall secondary voltage between nodes 364 and 366. The secondary voltage may be conditioned into a supply voltage for use by integrated circuit 362, to be described.

The embodiments described above may employ a variety of magnetic materials available in the given fabrication process for use as a magnetic core. For example, a mixture or alloy of nickel and iron (nickel ferrite or NiFe) may be deposited on at least one layer of a planar process to serve as a magnetic core. Other magnetic materials of high permeability may include CoTaZr (cobalt tantalum zirconium), and FeCo (ferrite cobalt)-based alloys.

Further, in the embodiments the number of turns employed in each winding may be configurable by a user. Transistors or other switches (not shown) may selectively connect portions of each winding or a varying number of complete turns of each winding to enable a particular stepping ratio to be achieved. Similarly, transistors or other switches may selectively connect multiple distinct windings, enabling any number of separate primary windings to be magnetically coupled to any number of separate secondary windings.

Figure 4:
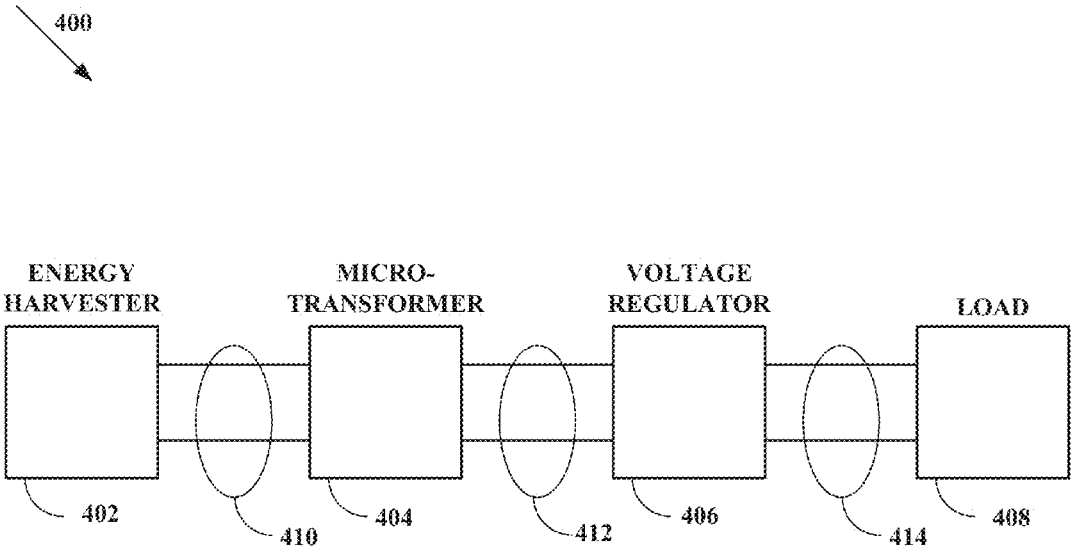
FIG. 4 is a block diagram depicting an exemplary micro-transformer power converter according to another embodiment of the present invention.

Referring now to FIG. 4, a block diagram depicting an exemplary micro-transformer power converter 400 according to another embodiment of the present invention is shown. An energy harvester, depicted as item 402, may generate output power at a very low alternating voltage (e.g., one mV to 20 mV, depicted as voltage 410). Such a voltage may be generally inadequate to serve as a supply voltage for even low-power integrated circuitry. A micro-transformer 404 may convert the voltage 410 provided by energy harvester 402 into a stepped up output voltage, depicted as voltage 412. A micro-transformer with a stepping ratio of 50 to 100 may for example yield between 50 mV to 2 V. A voltage regulator 406 may then rectify the stepped up output voltage 412 and control a resulting dc voltage 414 that is applied to a load 408. The load may comprise an integrated circuit that may include at least one of the energy harvester 402, micro-transformer 404, and voltage regulator 406. The efficiency of such conversion circuitry may vary considerably with applied load, so good regulation may be required.

Figure 5:
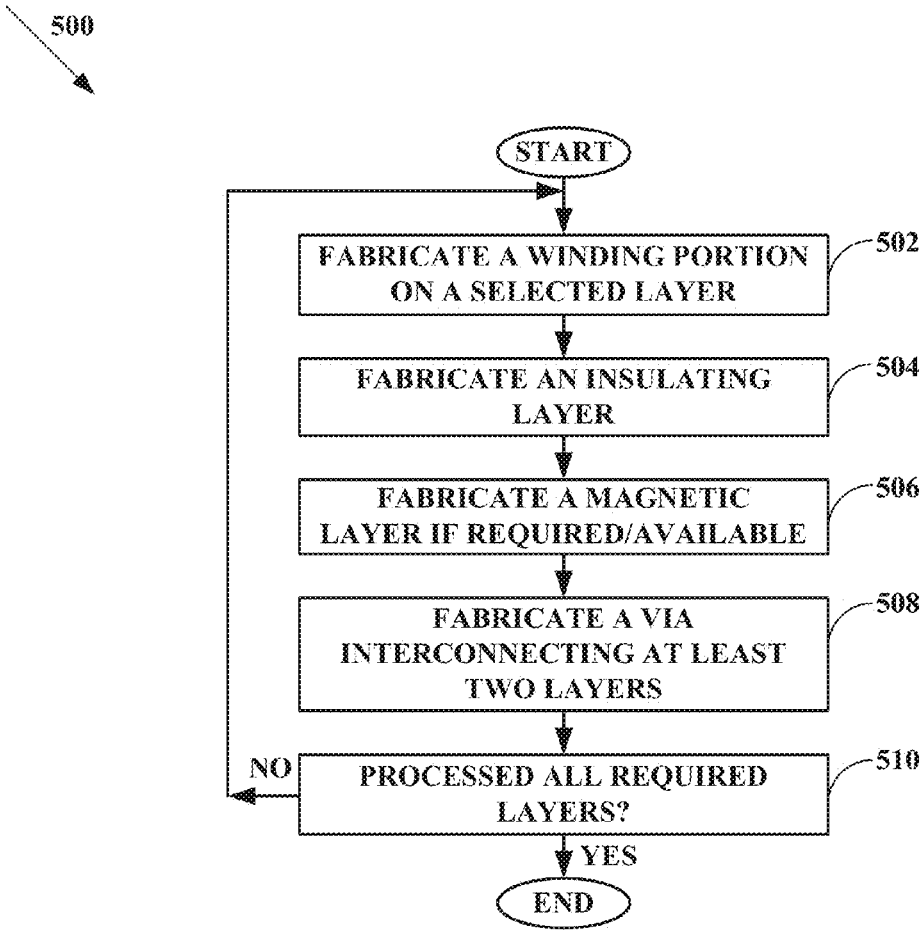
FIG. 5 is a flowchart depicting an exemplary micro-transformer manufacturing method according to a further embodiment of the present invention.

Referring now to FIG. 5, a flowchart depicting an exemplary micro-transformer manufacturing method according to a further embodiment of the present invention is shown. Exemplary steps may proceed from a lower-most layer upward. Step 502 comprises fabricating a winding portion on a selected layer. Step 504 comprises fabricating an insulating layer. Step 506 comprises fabricating a magnetic layer, if that is feasible in and is required of a given process. Step 508 comprises fabricating interconnecting structures, such as vias, to electrically link winding portions through intervening layers. If additional layers are required, as determined in exemplary step 510, the previous method steps may be repeated.

The fabricating steps may each be performed photolithographically. The lowest layer may comprise a substrate or an insulating layer, and the upper layer(s) may comprise an insulating layer or a conductive layer. The substrate may comprise a printed circuit board or semiconductor wafer that may include integrated circuitry. The insulating layers may comprise silicon dioxide, silicon nitride, or polyimide, for example, or other known passivating materials. The winding portions may comprise process metals, such as aluminum or copper for example. The interconnections may comprise vias formed from process metals, or from non-process metals, such as gold for example.

As described above, one aspect of the present invention relates to a micro-transformer. The provided description is presented to enable any person skilled in the art to make and use the invention. For purposes of explanation, specific nomenclature is set forth to provide a thorough understanding of the present invention. Description of specific applications and methods are provided only as examples. Various modifications to the preferred embodiments will be readily apparent to those skilled in the art and the general principles defined herein may be applied to other embodiments and applications without departing from the spirit and scope of the invention. Thus the present invention is not intended to be limited to the embodiments shown, but is to be accorded the widest scope consistent with the principles and steps disclosed herein.

What is claimed is:

1. A micro-transformer apparatus, comprising:

a first winding; and a second winding magnetically coupled to the first winding, wherein one winding comprises a number of turns connected in series and the other winding comprises a number of turns connected in parallel, wherein the windings are intertwined for improved magnetic coupling, and wherein turns of each winding comprise a number of patterned substantially planar conductive layers each separated by a substantially planar insulating layer, with at least two of the conductive layers electrically linked by a patterned interconnecting structure.

2. The apparatus of claim 1 wherein the windings have a magnetic coupling ratio of at least 0.8.

3. The apparatus of claim 1 wherein the apparatus converts an input voltage from an energy harvester into a stepped-up output voltage that, when regulated, supplies power for circuitry.

4. The apparatus of claim 1 wherein the apparatus achieves a power transfer efficiency of at least fifteen percent.

5. The apparatus of claim 1 wherein the apparatus includes a magnetic core positioned between the turns of the first and second windings.

6. The apparatus of claim 5 wherein the magnetic core comprises at least one of nickel ferrite (NiFe), cobalt tantalum zirconium (CoTaZr), and ferrite cobalt (FeCo).

7. The apparatus of claim 1 wherein the apparatus achieves a stepping ratio of from 50 to 100.

8. The apparatus of claim 1 wherein the apparatus processes signals alternating at a frequency of from 10 MHz to 100 MHz.

9. The apparatus of claim 1 wherein the conductive layers are provided on a semiconductor die.

10. The apparatus of claim 1 wherein the interconnecting structure comprises at least one of a process metal and a non-process metal.

11. The apparatus of claim 1 wherein the insulating layers galvanically isolate the second winding from the first winding and comprise at least one of silicon dioxide, silicon nitride, and polyimide.

12. The apparatus of claim 1 wherein the windings each comprise conductive stripe portions on at least two conductive layers, and conductive interconnections between those conductive layers.

13. The apparatus of claim 1 wherein the windings each have a conductive stripe portion on at least one common conductive layer.

14. A system for magnetically interrelating signals, comprising:

means for generating a magnetic field with a first electric current in a first winding; and means for inducing a voltage in a second winding, wherein the magnetic field couples the first winding and the second winding, and wherein one winding comprises conductors connected in series and the other winding comprises conductors connected in parallel, wherein the windings are intertwined for improved magnetic coupling, and wherein turns of each winding comprise a number of patterned substantially planar conductive layers each separated by a substantially planar insulating layer, with at least two of the conductive layers electrically linked by a patterned interconnecting structure.

15. The system of claim 14 wherein the windings have a magnetic coupling ratio of at least 0.8.

16. The system of claim 14 wherein the system converts an input voltage from an energy harvester into a stepped-up output voltage that, when regulated, supplies power for circuitry.

17. The system of claim 14 wherein the system achieves a power transfer efficiency of at least fifteen percent.

18. The system of claim 14 wherein the system includes a magnetic core positioned between the turns of the first and second windings.

19. The system of claim 18 wherein the magnetic core comprises at least one of nickel ferrite (NiFe), cobalt tantalum zirconium (CoTaZr), and ferrite cobalt (FeCo).

20. The system of claim 14 wherein the system achieves a stepping ratio of from 50 to 100.

21. The system of claim 14 wherein the system processes signals alternating at a frequency of from 10 MHz to 100 MHz.

22. The system of claim 14 wherein the conductive layers are provided on a semiconductor die.

23. The system of claim 14 wherein the interconnecting structure comprises at least one of a process metal and a non-process metal.

24. The system of claim 14 wherein the insulating layers galvanically isolate the second winding from the first winding and comprise at least one of silicon dioxide, silicon nitride, and polyimide.

25. The system of claim 14 wherein the windings each comprise conductive stripe portions on at least two conductive layers, and conductive interconnections between those conductive layers.

26. The system of claim 14 wherein the windings each have a conductive stripe portion on at least one common conductive layer.

27. A micro-transformer apparatus, comprising:

a first winding comprising a number of individual turns; and a second winding comprising a second number of individual turns, the second winding magnetically coupled to the first winding, wherein individual turns of one of the windings are connected to each other in series and individual turns of the other winding are connected to each other in parallel, wherein the windings are intertwined for improved magnetic coupling, and wherein turns of each winding comprise a number of patterned substantially planar conductive layers each separated by a substantially planar insulating layer, with at least two of the conductive layers electrically linked by a patterned interconnecting structure.

28. The apparatus of claim 27 wherein the apparatus includes a magnetic core positioned between the turns of the first and second windings.

29. The apparatus of claim 28 wherein the magnetic core comprises at least one of nickel ferrite (NiFe), cobalt tantalum zirconium (CoTaZr), and ferrite cobalt (FeCo).

30. The apparatus of claim 27 wherein the apparatus achieves a stepping ratio of from 50 to 100.

31. The apparatus of claim 27 wherein the apparatus processes signals alternating at a frequency of from 10 MHz to 100 MHz.

32. The apparatus of claim 27 wherein the conductive layers are provided on a semiconductor die.

33. The apparatus of claim 27 wherein the interconnecting structure comprises at least one of a process metal and a non-process metal.

34. The apparatus of claim 27 wherein the insulating layers galvanically isolate the second winding from the first winding and comprise at least one of silicon dioxide, silicon nitride, and polyimide.

* * * * *